US010995770B2

(12) United States Patent
Pagnier et al.

(10) Patent No.: US 10,995,770 B2
(45) Date of Patent: May 4, 2021

(54) DIFFUSER FOR A FLUID COMPRESSION DEVICE, COMPRISING AT LEAST ONE VANE WITH OPENING

(71) Applicants: IFP Energies nouvelles, Rueil-Malmaison (FR); ONESUBSEA IP UK LIMITED, London (GB)

(72) Inventors: Philippe Pagnier, Saint Clair du Rhone (FR); Veronique Penin, Lyons (FR); Anders Brunvold, Blomsterdalen (NO); Ina Ekeberg, Laksevaag (NO); Erik Torbergsen, Fyllingsdalen (NO)

(73) Assignees: IFP Energies nouvelles; ONESUBSEA IP UK LIMITED, London (GB)

( * ) Notice: Subject to any disclaimer, the term of this patent is extended or adjusted under 35 U.S.C. 154(b) by 197 days.

(21) Appl. No.: 15/785,855

(22) Filed: Oct. 17, 2017

(65) Prior Publication Data

US 2018/0106270 A1 Apr. 19, 2018

(30) Foreign Application Priority Data

Oct. 19, 2016 (EP) ..... 16306372

(51) Int. Cl.

| | |
|---|---|
| ***F04D 29/54*** | (2006.01) |
| ***F04D 31/00*** | (2006.01) |
| ***F04D 29/18*** | (2006.01) |

(52) U.S. Cl.

CPC ..... *F04D 29/54* (2013.01); *F04D 29/181* (2013.01); *F04D 29/542* (2013.01); *F04D 31/00* (2013.01)

(58) Field of Classification Search

CPC ..... F04D 29/54; F04D 29/544; F04D 29/242; F04D 29/44; F04D 29/442; F04D 29/444; F04D 29/441

See application file for complete search history.

(56) References Cited

U.S. PATENT DOCUMENTS 1,536,754 A * 5/1925 Benson ..... F04D 3/005 415/190

4,365,932 A 12/1982 Arnaudeau (Continued)

FOREIGN PATENT DOCUMENTS

CN 1392346 A 1/2003

CN 102312860 A 1/2012

(Continued)

OTHER PUBLICATIONS

Extended European Search Report for 16306372.0-1610 (7 Pgs.).

(Continued)

*Primary Examiner* — Courtney D Heinle

*Assistant Examiner* — John S Hunter, Jr.

(74) *Attorney, Agent, or Firm* — Fitch, Even, Tabin & Flannery, LLP

(57) ABSTRACT

A diffuser for a fluid compression device includes at least one vane mounted on a hub. The at least vane includes at least one opening (5) starting at a distance ranging between 10% and 60% of the axial length of the vane. The diffuser can be used in a fluid compression device also including a housing, at least one impeller within the housing, the impeller including at least one vane, the diffuser being arranged within the housing, upstream or downstream from said impeller.

5 Claims, 9 Drawing Sheets

(56) References Cited

U.S. PATENT DOCUMENTS

| | | | | |
|---|---|---|---|---|
| 4,824,325 | A * | 4/1989 | Bandukwalla | F04D 29/444 415/208.4 |
| 5,375,976 | A | 12/1994 | Arnaudeau | |
| 5,885,058 | A | 3/1999 | Vilagines et al. | |
| 6,036,432 | A | 3/2000 | Sishtla et al. | |
| 6,149,385 | A | 11/2000 | Vilagines et al. | |
| 6,857,845 | B2 | 2/2005 | Stabley et al. | |
| 7,100,151 | B2 | 8/2006 | Johnsen et al. | |
| 8,221,067 | B2 | 7/2012 | Pagnier | |
| 9,394,794 | B2 * | 7/2016 | Guemmer | F01D 5/145 |
| 2001/0036401 | A1 | 11/2001 | Harvey et al. | |
| 2011/0255962 | A1 | 10/2011 | Porodo et al. | |
| 2012/0148396 | A1 * | 6/2012 | Guemmer | F01D 5/146 415/208.2 |

FOREIGN PATENT DOCUMENTS

| | | | |
|---|---|---|---|
| CN | 105179322 | A | 12/2015 |
| CN | 105452667 | A | 3/2016 |
| DE | 19548852 | A1 | 7/1997 |
| EP | 0556895 | A1 | 8/1993 |
| FR | 2743113 | A1 | 7/1997 |
| JP | H10331794 | A | 12/1998 |
| JP | 2005-155565 | A | 6/2005 |

OTHER PUBLICATIONS

Office action of CN Appln. No. 201710971457.0 dated Apr. 28, 2020 (English translation).
Office action in CN Appln. No. 201710971457.0 dated Sep. 18, 2020.

* cited by examiner

DIFFUSER FOR A FLUID COMPRESSION DEVICE, COMPRISING AT LEAST ONE VANE WITH OPENING

CROSS-REFERENCE TO RELATED APPLICATIONS

This application claims the benefit of French Patent Application No. 16.306.372.0 filed Oct. 19, 2016, the contents of which are incorporated herein by reference as if fully rewritten herein.

TECHNICAL FIELD

The present disclosure relates to the field of fluid compression or pumping devices, and it more specifically concerns a diffuser of a fluid compression or pumping device.

A diffuser is one of the two components of a compression or pumping cell. Known diffusers enable to fulfil the dual function, on the one hand, of straightening the flow from a revolving wheel arranged upstream from the diffuser so as to be able to feed the next compression stage and, on the other hand, of converting the kinetic energy of the fluid to potential energy. To achieve this, the diffuser might comprise at least one or a plurality of vanes, also referred to as vane assembly. The diffuser is stationary with respect to the housing of the compression or pumping cell or device.

Another known component of a compression or pumping cell is the dynamic wheel also referred to as an impeller. This dynamic wheel enables to increase the fluid energy. The dynamic wheel can be secured to a rotating shaft and comprise at least one or a plurality of vanes, also referred to as impeller assembly.

A known compression or pumping cell can be an assembly comprising a dynamic wheel and a diffuser.

BACKGROUND

FIG. 1 shows an example of a multiphase pump of a known Poseidon® type (IFP Energies Nouvelles, France) comprising at least one or a plurality of stages (FIG. 1 shows only one stage), each stage comprising a dynamic wheel 1 and a diffuser 2. Dynamic wheels are secured to the hub 10. Dynamic wheels 1 may comprise a plurality of vanes 3 and diffusers 2 may comprise a plurality of vanes 4. In this figure, the direction of flow is shown by an arrow S.

Due to the geometric shape of some compression cells, like the ones of the Poseidon® type, the flow may form, with the axis of rotation of the cell, a very large angle at the dynamic wheel outlet (example values can be of the order of 60° to 70°). Therefore, the flow passing through the diffusers might undergo an angle variation that can reach 70° over a relatively short axial distance. Thus, the geometry of these diffusers does not allow efficient straightening of the flow from the revolving wheel, so that the flow might leave the diffuser with a residual angle.

Under such conditions, a high diffusion might occur in the channels bounded by successive vanes of a diffuser, thus might generate a very large flow recirculation zone. In example, a channel is understood to be a space provided between two successive vanes of a diffuser, the channel being limited by the hub and by the housing in which the diffuser might be arranged.

FIG. 2 shows, for example, the case of a flow disturbance wherein a swirl can occur in five successive channels of a diffuser. Moreover, the extent of the recirculation might be different from one channel to another. The example of FIG. 2 furthermore shows the direction of flow denoted S at the diffuser inlet, the theoretical direction denoted Sth of the flow at the diffuser outlet and the real direction denoted Sre of the flow at the diffuser outlet. It can be noted that, for this configuration, the real direction of flow does not correspond to the desired theoretical direction.

When the flow rate becomes relatively low, a change in the incidence angle of the flow on the leading edge of the diffuser might occur, which can lead to a boundary layer separation whose effects might add up to the presence of swirls. This situation is known in the field of turbomachines as "rotating stall". These disturbances, which might appear in the impellers as well as in the diffusers, might generate hydraulic instability that propagates from one channel to another at a different speed than the rotational speed of the impellers (dynamic wheels).

The rotating stall, once initiated when, for example, the flow rate is low (for example less than about 0.8 times the nominal flow rate) or, for example, when the flow rate is above the nominal flow rate (for example about 1.2 times the nominal flow rate), can generate pressure fluctuations whose amplitude depends on both the number of channels that can be obstructed by the vortices and the energy in the fluid. In the some case, wherein the simultaneous obstruction of all the channels occurs, the rotating stall might become markedly more violent, with a pump unpriming/repriming cycle. This phenomenon is known as surge.

Some patents deal with the problem of hydraulic instability in pumps. U.S. Pat. Nos. 6,036,432 and 6,857,845 relative to techniques for detecting rotating stalls in centrifugal compressors can be mentioned.

Besides, U.S. Pat. No. 7,100,151 B2 proposes trimming the leading edge at the diffuser vane housing, in the case of centrifugal compressors, in order to reduce or to displace downstream the separation of the boundary layers.

With patent FR-2,743,113, it was proposed to arrange the impeller vanes of a multiphase pump in tandem. This vane tandem arrangement allows to minimize the liquid and gas phase separation, to reduce hydraulic energy losses and to improve guidance of the fluid flowing through the diffuser, but it does not allow to reduce or to remove hydraulic instabilities such as the rotating stall that might appear at partial flow rate.

The present disclosure describes a diffuser for a fluid compression device, comprising at least one vane mounted on a hub. In embodiments of the disclosure, at least one opening is provided in the diffuser vanes, in the radial direction, so as to reduce or to remove hydraulic instabilities such as rotating stalls.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

The present disclosure concerns a diffuser for a fluid compression device, comprising at least one vane mounted on a hub. Said vane comprises at least one opening, said at least one opening starting at a distance ranging between 10% and 60% of the axial length of said vane.

According to embodiments of the disclosure, the at least one opening comprises a slot.

According to embodiments of the disclosure, said slot has an axial length ranging between 10% and 40% of the axial length of said vane.

According to embodiments of the disclosure, said slot is provided over at least half the height of said vane, starting from the outer edge of said vane toward the center of said compression device.

According to embodiments of the disclosure, said slot is provided over the total height of said vane.

According to embodiments of the disclosure, said slot is substantially perpendicular to the axis of said fluid compression device.

According to embodiments of the disclosure, said slot is inclined toward downstream according to the direction of flow of the fluid on said diffuser.

According to embodiments of the disclosure, said slot is substantially perpendicular to the surface of said vane.

According to embodiments of the disclosure, said vane comprises a single slot.

According to embodiments of the disclosure, said at least one opening starts at a distance ranging between 45% and 55% of the axial length of said vane.

According to embodiments of the disclosure, the diffuser comprises a plurality of openings containing holes that are aligned substantially.

According to embodiments of the disclosure, the alignment of holes is substantially perpendicular to the axis of said fluid compression device.

According to embodiments of the disclosure, the alignment of holes is inclined toward downstream according to the direction of flow of the fluid on said diffuser.

According to embodiments of the disclosure, the opening is formed by a distance piece disposed between two diffusor parts of the diffuser.

According to embodiments of the disclosure, the two diffusor parts comprise different configurations of the diffuser vanes in number, angle, length and/or shape.

In addition, the present disclosure concerns a fluid compression device comprising a housing, at least one impeller within said housing, said impeller comprising at least one vane. In that said compression device comprises at least one diffuser according to the disclosure, said diffuser being arranged within said housing, upstream or downstream from said impeller.

Further, the present disclosure concerns the use of a fluid compression device according to the disclosure for compression or pumping of a multiphase fluid.

According to embodiments of the disclosure, the use concerns the pumping a multiphase petroleum effluent.

BRIEF DESCRIPTION OF THE FIGURES

The subject disclosure is further described in the following detailed description, and the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness.

DISCLOSURE

Figure 1:
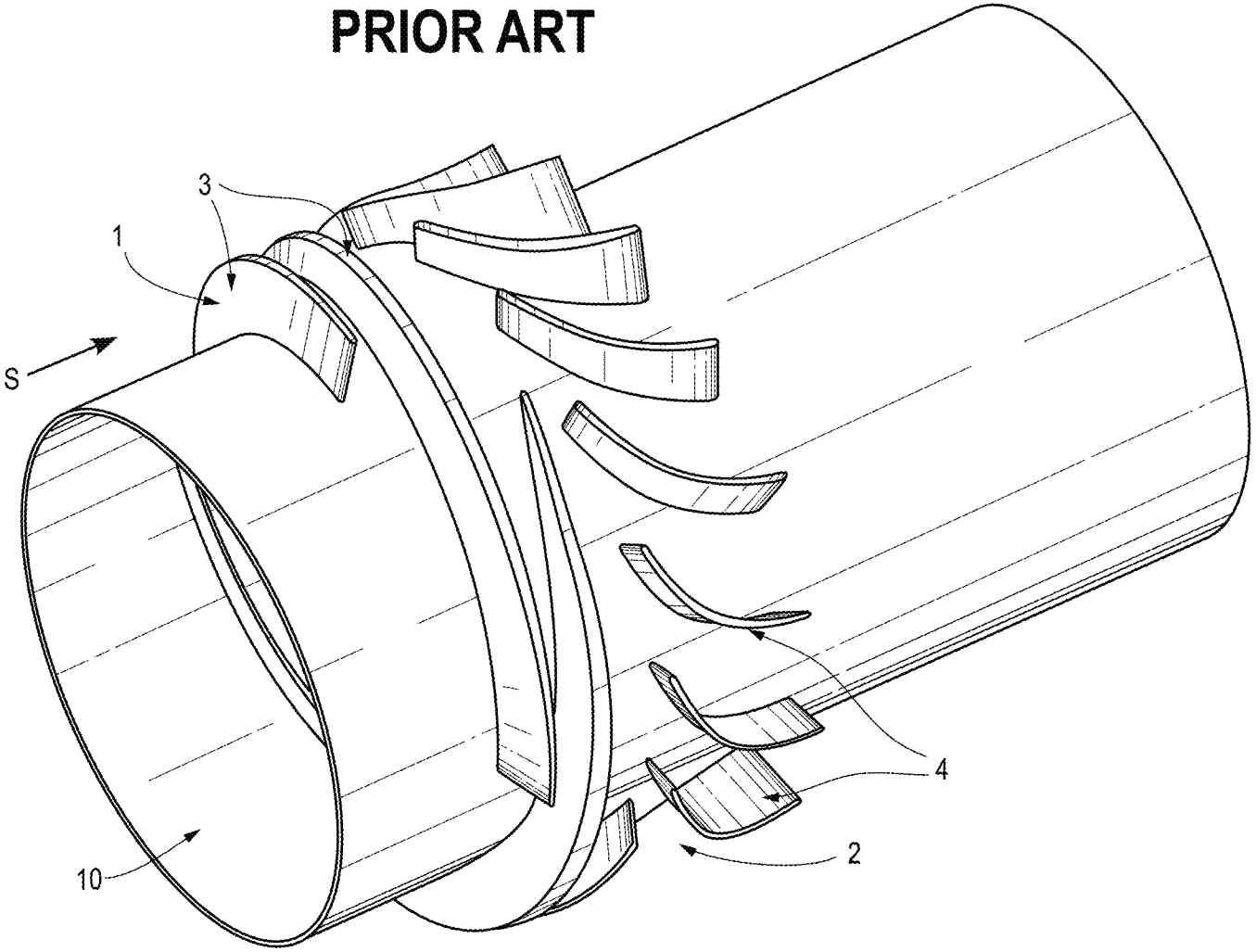
FIG. 1 PRIOR ART
Figure 2:
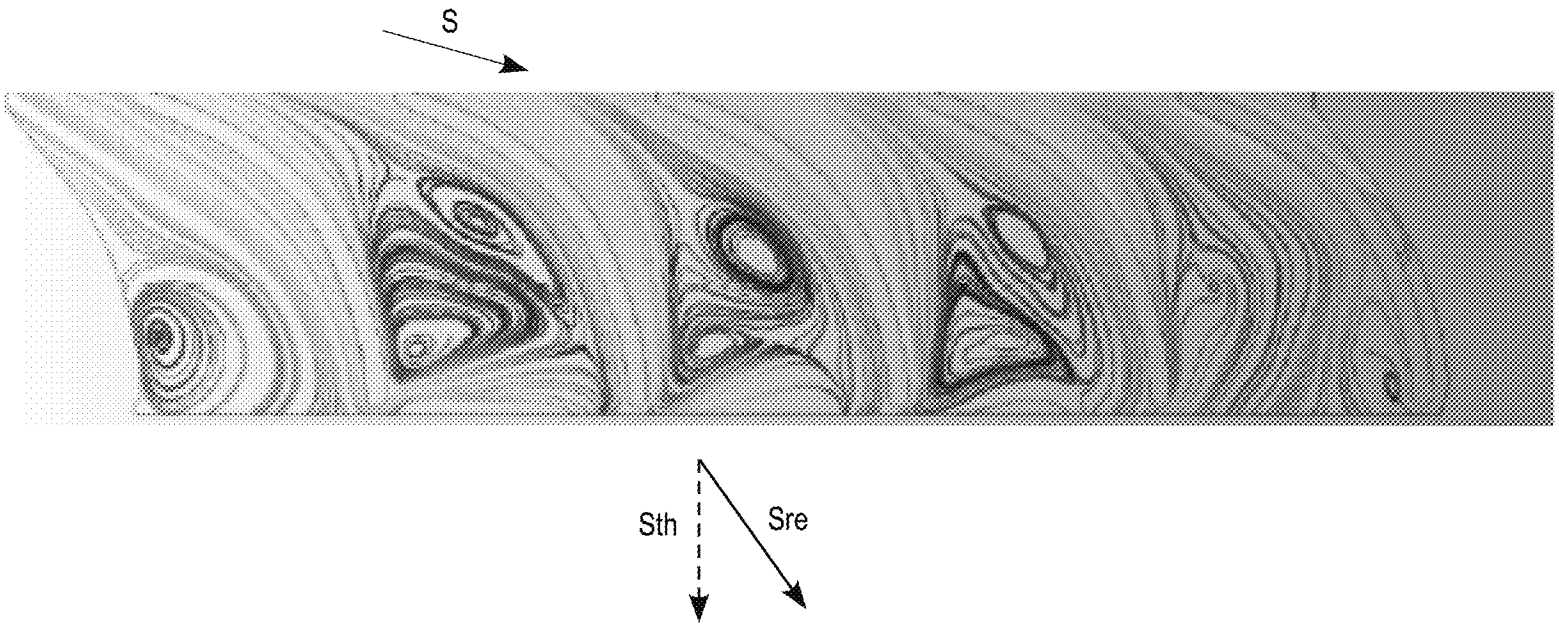
FIG. 2 PRIOR ART
Figure 3:
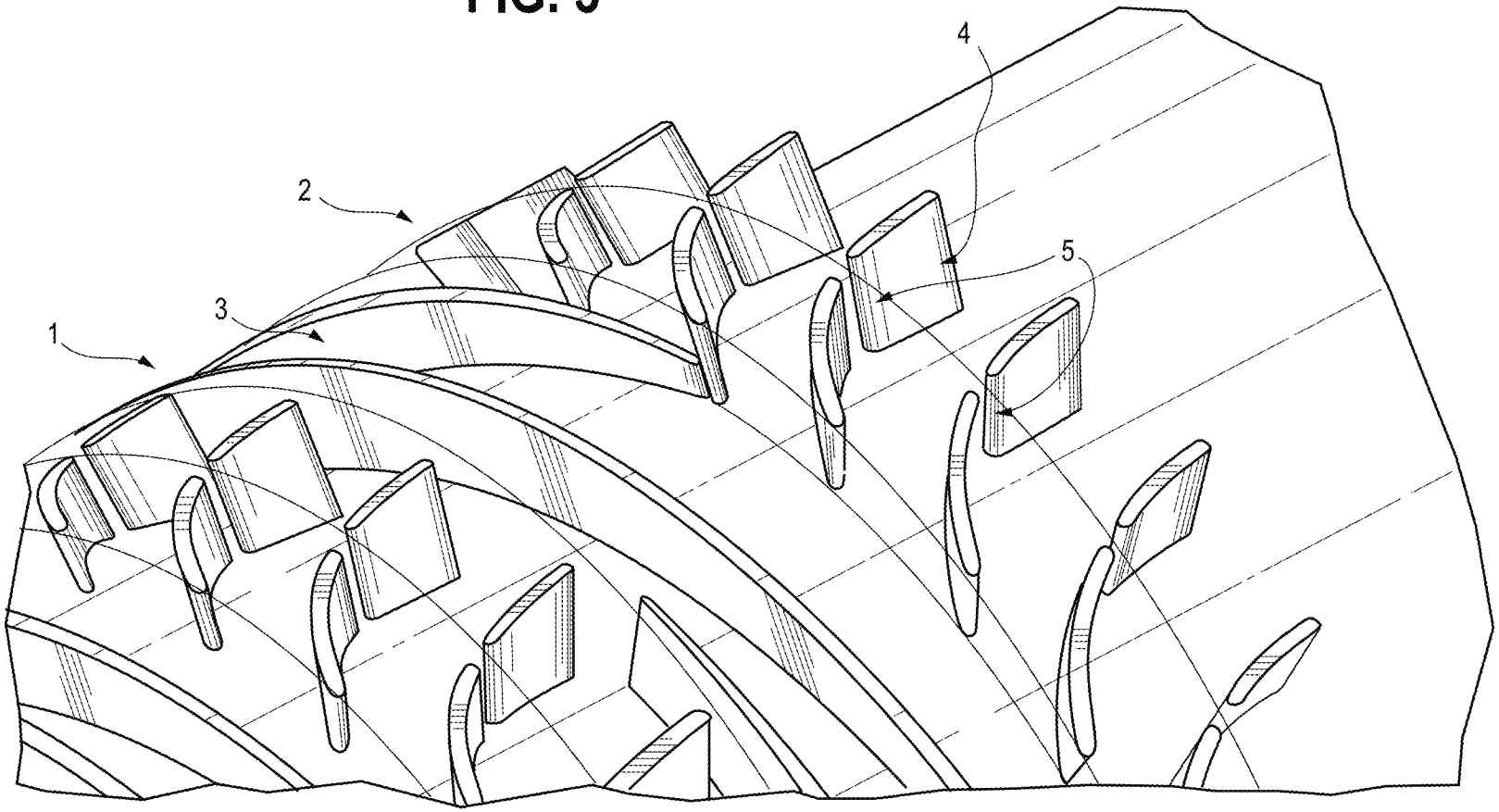
Figure 4:
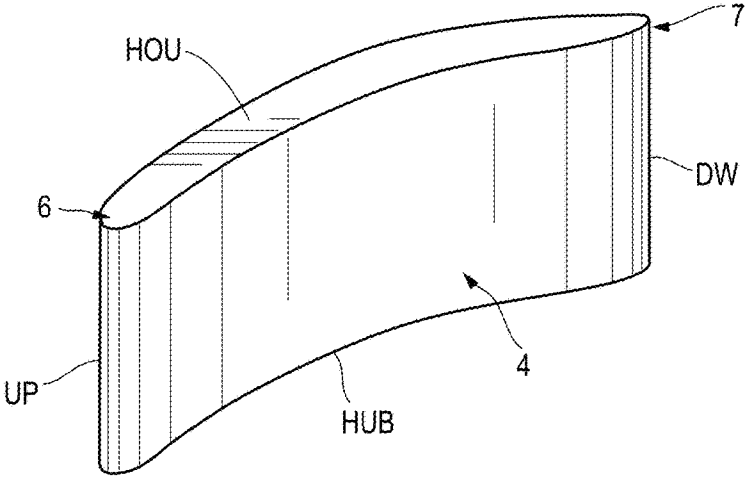
FIG. 4 PRIOR ART
Figure 8:
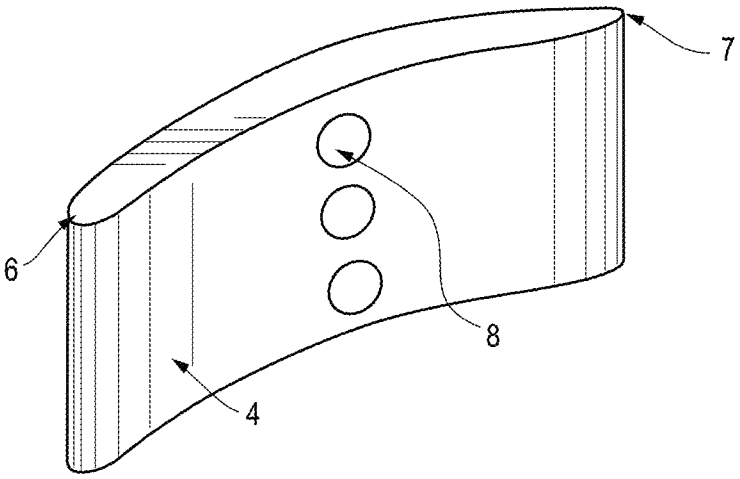
Figure 9:
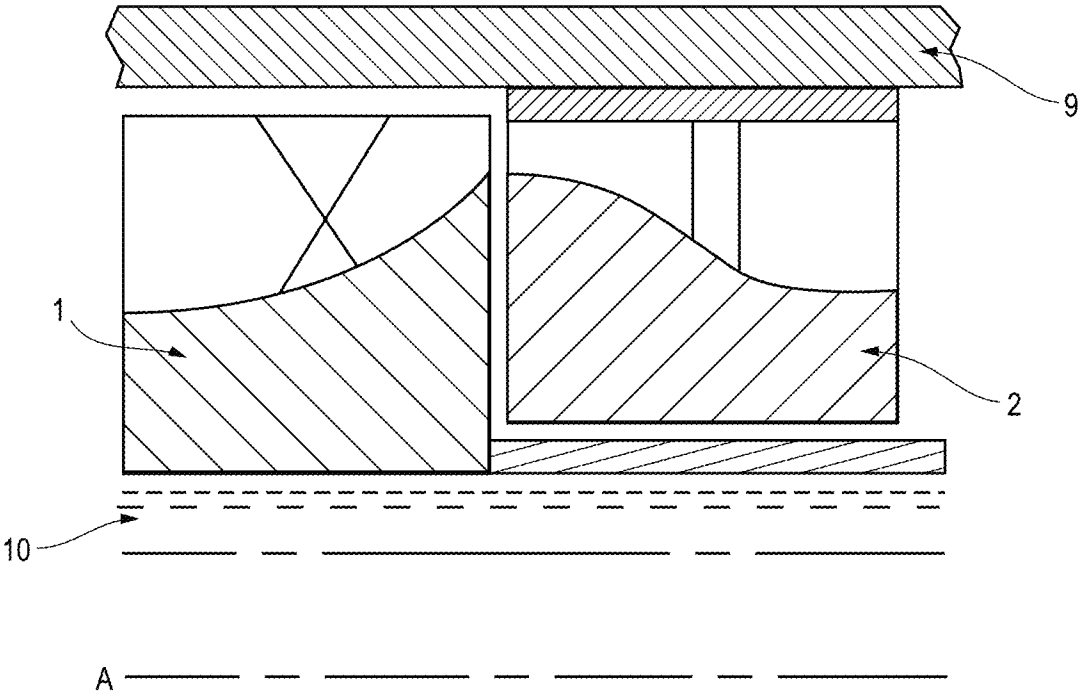
Figure 10:
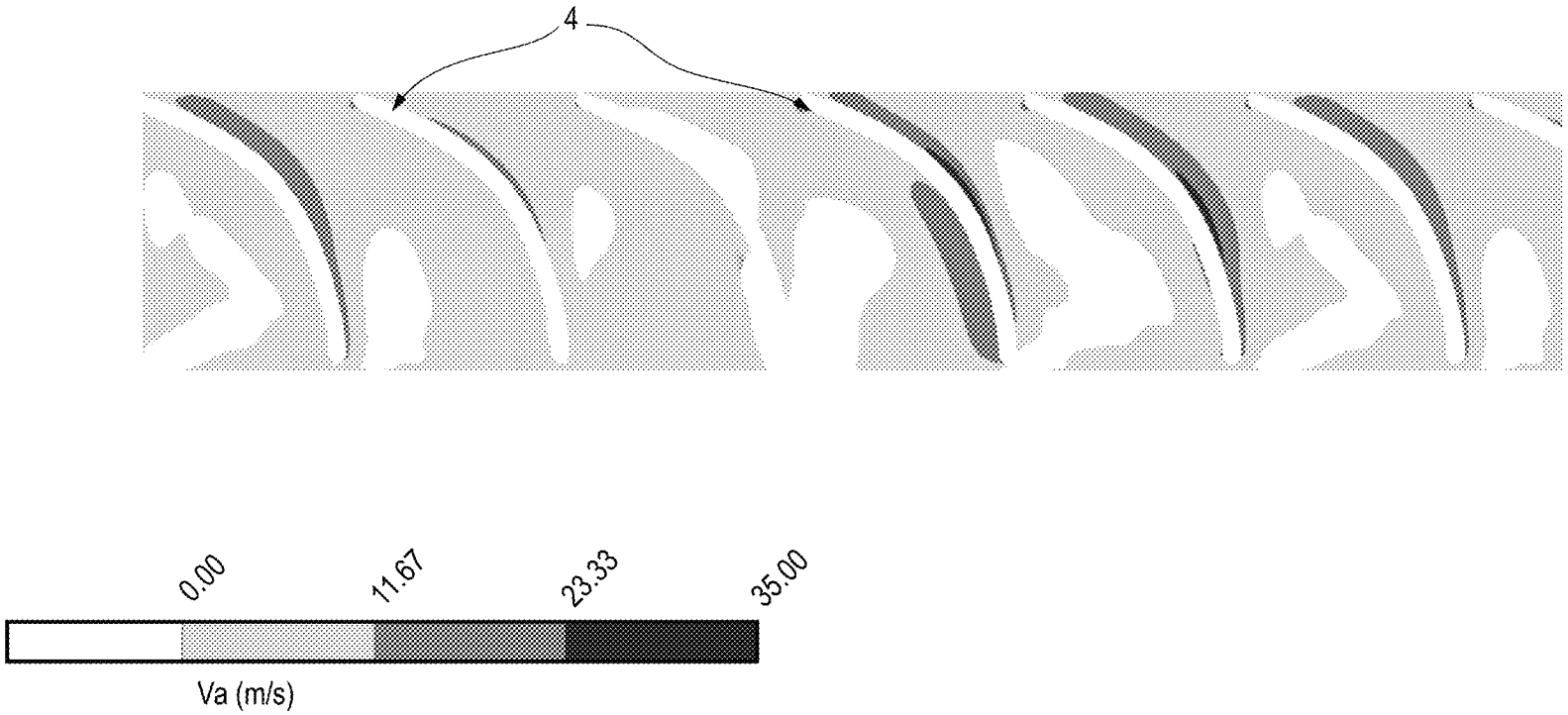
FIG. 10 PRIOR ART
Figure 11:
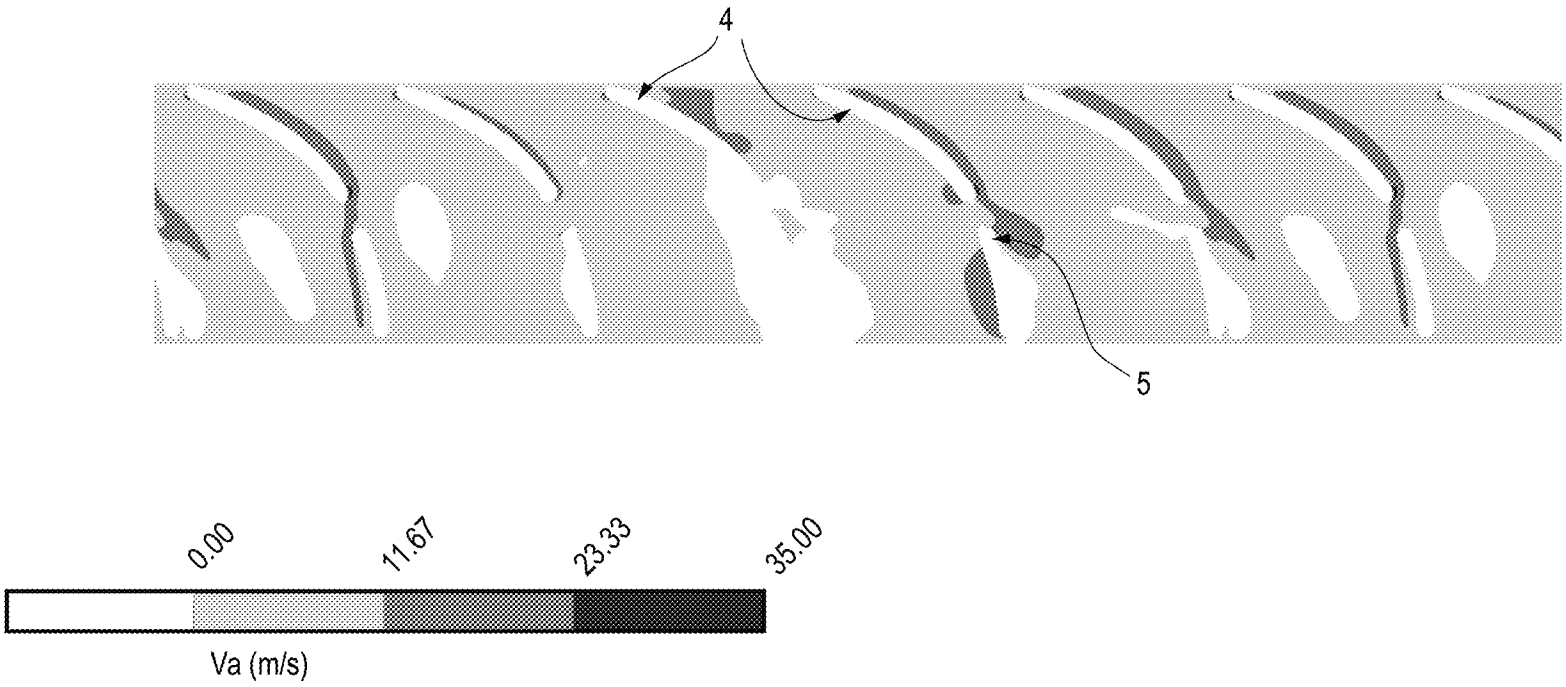
Figure 12:
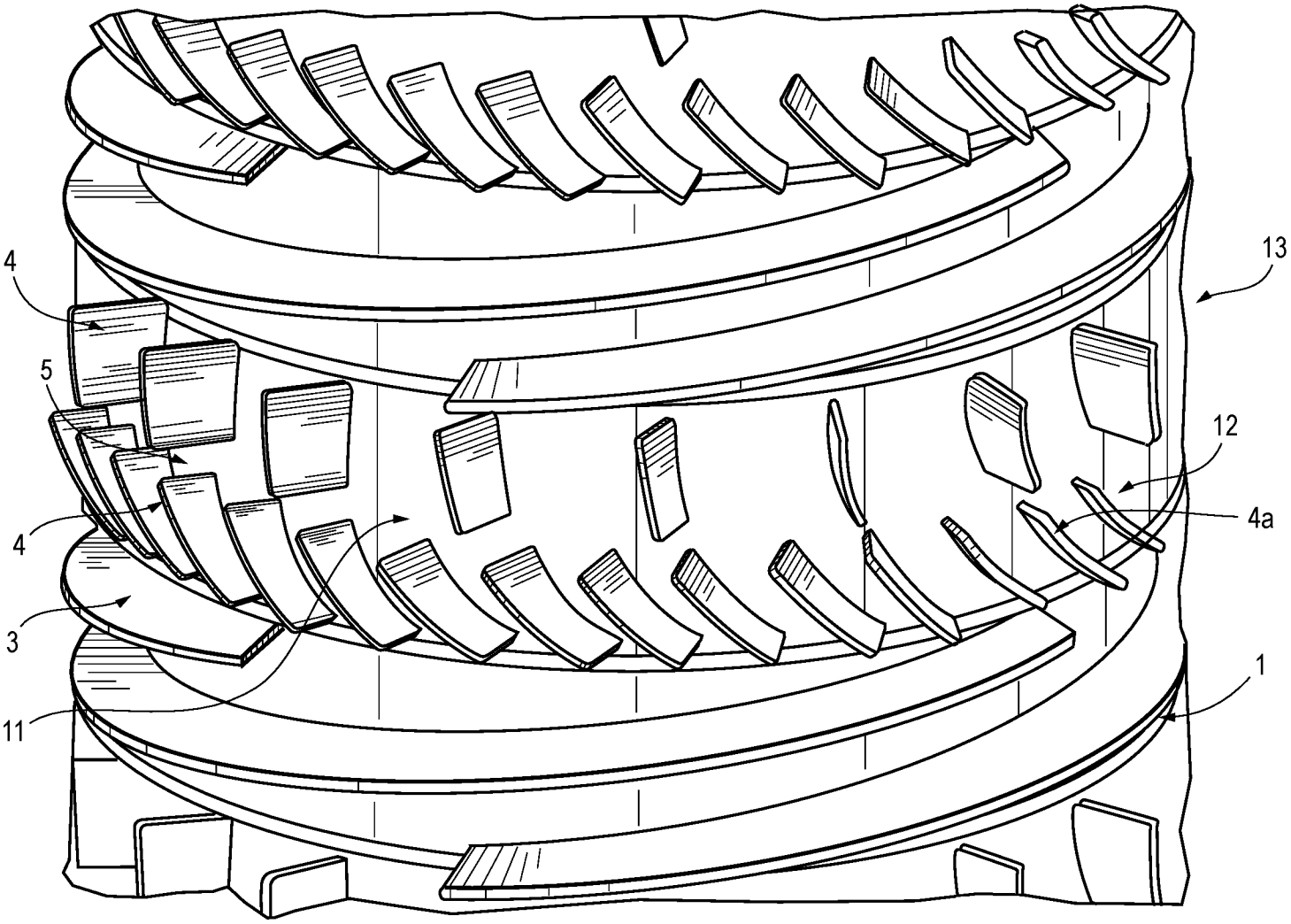

FIG. 1 illustrates an example of a pump according to the prior art;

FIG. 2 illustrates an example of the flows within the diffuser for a pump according to the prior art, FIG. 3 illustrates a schematic pump according to one or more embodiments of the present disclosure, FIG. 4 shows a vane of a diffuser according to the prior art, FIGS. 5 to 8 show variant embodiments of a vane of a diffuser according to the present disclosure, FIG. 9 diagrammatically shows, in axial section, a particular embodiment of the device according to the disclosure;

FIG. 10 shows example of fluid flow velocities for a diffuser according to the prior art, FIG. 11 shows example of fluid flow velocities for a diffuser according to embodiments of the disclosure, and FIG. 12 shows an embodiment of a vane of a diffuser according to the present disclosure.

DETAILED DESCRIPTION

The particulars shown herein are for purposes of illustrative discussion of the embodiments of the present disclosure only. In this regard, no attempt is made to show structural details of the present disclosure in more detail than is necessary for the fundamental understanding of the present disclosure, the description taken with the drawings making apparent to those skilled in the art how the several forms of the present disclosure may be embodied in practice.

As used herein the term "diffuser" refers to any diffuser blade, regardless of whether the fluid is air, another gas, a mixture of gas and liquid, or a liquid. As used herein the term «fluid compression device» refers to fluid compressors as well as fluid pumps, both topside, subsea or downhole (i.e. within subterranean formations). Further, like reference numbers and designations in the various drawings indicate like elements.

When introducing elements of various embodiments of the present disclosure, the articles "a," "an," "the," and "said" are intended to mean that there are one or more of the elements. The terms "comprising," "including," and "having" are used in an open-ended fashion, and thus should be interpreted to mean "including, but not limited to." Also, any use of any form of the terms "connect," "engage," "couple," "attach," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

The present disclosure describes embodiments of a diffuser for a fluid compression device. The diffuser comprises at least one diffuser vane mounted on a hub or on a housing. In embodiments, the diffuser comprises plurality of diffuser vanes. According to an embodiment of the disclosure, at least one diffuser vane comprise(s) at least one opening.

An opening is understood to comprise a slot or a groove or a hole provided in the diffuser vane. The slot might be provided in the radial direction of the compression (or pumping) device. In embodiments, the hole traverses the diffuser vane. In embodiments, the opening enables the fluid present in the compression device to flow from one side to the other of the diffuser. In embodiments, the opening thus enables to equalize the flow of fluid from one channel to another by transferring fluid from the high pressure side of the vanes to the channels that might be obstructed by a vortex. The leakage flow thus contributes to prevent hydraulic instabilities such as the rotating stall phenomenon. In embodiments, a channel comprises a space provided between two consecutive vanes of a diffuser, the channel being limited by the hub and by the housing in which the diffuser is arranged. In embodiments of the disclosure, the compression device comprises a plurality of diffuser vanes. In embodiments, each of the diffuser vanes comprises at last one opening.

According to the disclosure, the at least one opening can be made in the vane, starting from a percentage of the axial length of the vane ranging between about 10 and 60%, for example at a distance ranging between about 45% and 55% of the axial length of the vane.

According to some embodiments of the disclosure, the at least one opening comprises a slot. According to some embodiments of the disclosure, the slot might be provided with an axial length ranging between about 10% and 40% of the axial length of the vane. In embodiments, the slot is provided with an axial length ranging between 10% and 20% of the axial length of the vane. The opening enables to obtain a leakage flow velocity breaking up the swirling structure in the adjacent channel, while keeping a good flow deflection upon passage through the diffuser.

By way of non limitative example, a slot with a length between 6 and 21 mm can be provided in a diffuser having an axial length of 54 mm. According to another non limitative example, a slot with a length between 7 and 27 mm can be provided in a diffuser having an axial length of 68 mm.

By way of non limitative example, a hole with a diameter between 6 and 21 mm can be provided in a diffuser having an axial length of 54 mm. According to another non limitative example, holes with a diameter between 7 and 27 mm can be provided in a diffuser having an axial length of 68 mm.

According to embodiments of the disclosure, the slot can have the shape of a rectangle, an oblong, a parallelogram or any similar shape.

According to embodiments of the disclosure, the hole can have the shape of circle, a rectangle, an ellipse or any similar shape.

According to embodiments of the disclosure, the slot might be provided at the outer edge of the vane, i.e. the edge of the vane at a distance from the hub. Thus, the slot opens onto the outer edge of the vane.

According to embodiments of the disclosure that might optimize the fluid circulation and therefore the flow equalization, the slot might be provided over about half the height of the vane, or over about two thirds of the height of the vane, or over the total height of the vane.

According to embodiments of the disclosure, the slot can be perpendicular to the axis of rotation of the compression device so as to promote equalization of the fluid flow.

According to embodiments of the disclosure, the slot can be substantially perpendicular to the axis of the fluid compression device.

According to embodiments of the disclosure, the slot can be inclined toward downstream (according to the direction of flow of the fluid), i.e. the end of the slot opening onto the outer edge of the vane might be arranged downstream from the other end of the slot. This layout allows to increase the leakage flow toward the housing where the vortex might be the greatest.

According to embodiments of the disclosure, a plurality of openings is provided and comprises holes that can be aligned. In embodiments, the alignment of holes is substantially perpendicular to the axis of rotation of the compression device so as to promote equalization of the fluid flow.

According to embodiments of the disclosure, the alignment of holes can be inclined toward downstream (according to the direction of flow of the fluid), i.e. the end of the alignment opening onto the outer edge of the vane might be arranged downstream from the other end of the alignment. This layout might allow to increase the leakage flow toward the housing where the vortex might be the greatest.

According to embodiments of the disclosure, the plurality of holes might be provided at the outer edge of the vane, i.e. the edge of the vane at a distance from the hub. Thus, the holes open onto the outer edge of the vane.

According to embodiments of the disclosure that might optimize the fluid circulation and therefore the flow equalization, the plurality of holes might be provided over about half the height of the vane, or over about two thirds of the height of the vane, or over the total height of the vane.

According to embodiments of the disclosure, two sequential diffusor parts can be embedded between each impeller. Each diffusor part comprises diffuser vanes. A distance piece can be used between said two sequential diffusor parts. So, the distance piece forms the opening in the diffuser vanes. This embodiment allows a best orientation of the flow, and allows to break the turbulences.

The configuration of the diffusor vanes could be in different numbers, angles, length and shape for each diffusor part. According to embodiments of the disclosure, the number of blades could be different from one diffusor part to the other.

FIG. 3 illustrates by way of non limitative example a portion of a compression device according to an embodiment of the disclosure. FIG. 3 is a similar view to FIG. 1, enlarged. In the embodiments, the compression (or pumping) device comprises an impeller (dynamic wheel) 1 comprising a plurality of vanes 3 and a diffuser 2 comprising a plurality of vanes 4. Each vane 4 of diffuser 2 comprises a slot 5 provided substantially in the center of the vane, in the axial direction. As illustrated, slots 5 might be provided over the entire height of the vane. However, other heights may be considered, for example about 50% or about ⅔ of the height of the vane.

FIG. 4 illustrates an example a vane 4 of a diffuser according to the prior art. In this figure, the leading edge 6 (UP), based upstream where the fluid comes from, is in the foreground and the trailing edge 7 (DW), based downstream where the fluid flows off, is in the background. The part of the vane HUB facing the hub corresponds to the lower part of the vane shown, and the part of the vane HOU facing the housing is the upper part of the vane. The general shape of vane 4 is schematically shown.

FIGS. 5 to 8 show, by way of schematic non limitative example, variant embodiments of a vane of a diffuser according to the disclosure. Vanes 4 of FIGS. 5 to 8 are oriented in same way than the vane 4 of FIG. 4.

Figure 5:
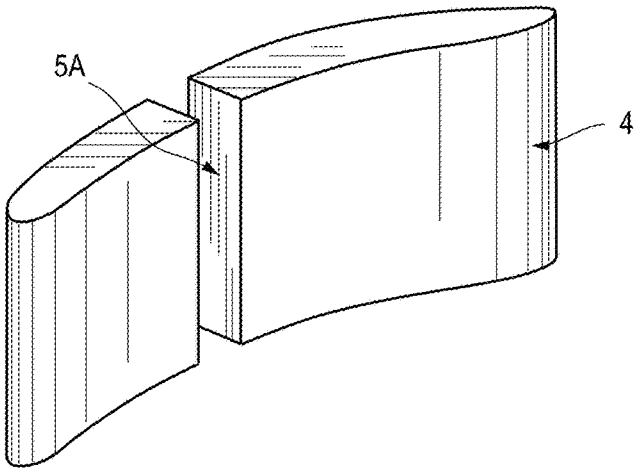

FIG. 5 illustrates an embodiment of a vane 4 comprising a slot 5A. Slot 5A is substantially perpendicular to the axis of the hub. Furthermore, as represented on the figure, slot 5A might be provided over the total height of vane 4.

Figure 6:
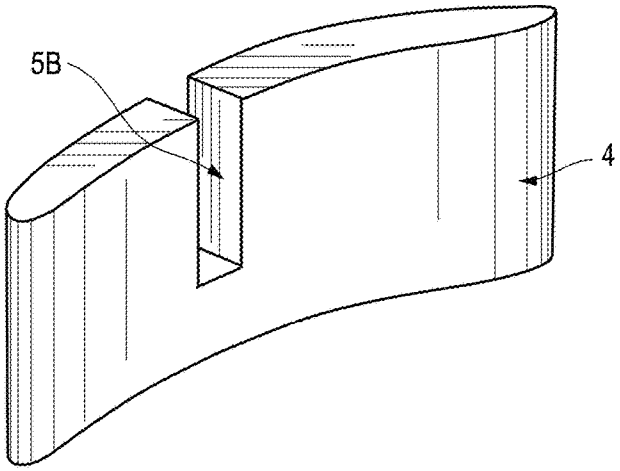

FIG. 6 illustrates an embodiment of a vane 4 comprising a slot 5B. Slot 5B is substantially perpendicular to the axis of the hub. Furthermore, slot 5B might be provided over substantially two thirds of the height of vane 4, as presented on the figure.

Figure 7:
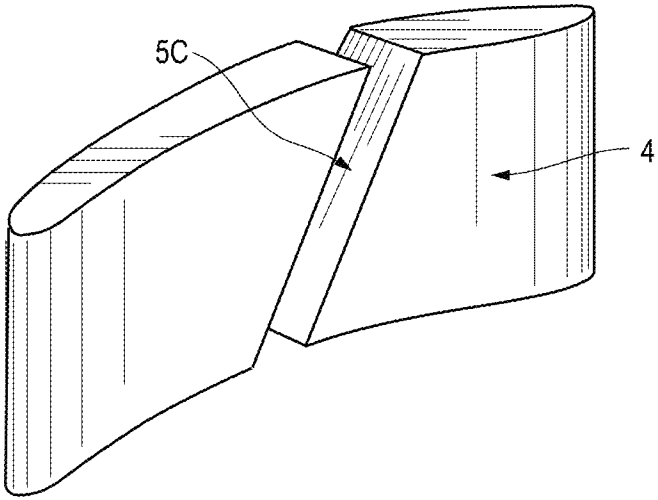

FIG. 7 illustrates an embodiment of a vane 4 comprising a slot 5C. Slot 5C might be inclined toward downstream, i.e. from the hub to the housing. Furthermore, slot 5C might be provided over the total height of the vane.

FIG. 8 illustrates an embodiment of a vane 4 comprising a plurality of holes 8. Three holes 8 are aligned, but this number of openings is non-limitative. In variant of this embodiment, the vane can comprise a number of holes between 2 and 8, for example 2, 4, 5 or 6. The alignment of holes 8 are substantially perpendicular to the axis of the hub. Furthermore, as represented on the figure, the alignment of holes might be provided over the total height of vane 4.

Other embodiments can be considered, for example, an inclined slot with a height corresponding substantially to half or two thirds of the height of the vane, a plurality of openings provided over substantially one half or two thirds of the height of vane, etc.

FIG. 12 illustrates a plurality of stages (FIG. 12 shows two stage) of a multiphase pump, each stage comprising a dynamic wheel 1 and a diffuser 2. Dynamic wheels 1 may comprise a plurality of vanes 3 and diffusers 2 may comprise a plurality of vanes 4 according an embodiment of the disclosure and a plurality of vanes 4*a*. In said embodiment, two sequential diffusor parts 12, 13 are embedded between each impeller 3. The two diffusor parts 12, 13 may have substantially the same axial length. Each diffusor part 12, 13 comprises vanes 4, 4*a*. A distance piece 11 is used between said two sequential diffusor parts 12, 13. The distance piece 11 forms an opening 5, which separate the vanes 4 in two parts. The first diffusor part 12 comprises vanes 4 and vanes 4*a*, and the second diffusor part 13 comprises only vanes 4. A vane 4*a* is inserted between two vanes 4. So, the first diffusor part 12 comprise twice more vanes than the second diffusor part 13.

Embodiments of the disclosure furthermore describe a fluid compression or pumping device comprising a housing, at least one impeller within the housing and equipped with at least one vane, and at least one diffuser according to one of the embodiments described above (the various characteristics can be combined). The diffuser might be arranged within the housing upstream and/or downstream from the Impeller.

The housing might be provided with at least one fluid inlet port and at least one fluid discharge port. The impellers might be secured to a shaft on which they can be press fitted, and the shaft can be driven in rotation. A diffuser can be arranged at the outlet of each impeller.

In embodiments, the compression or pumping device according to the disclosure can be an axial pump, a radial pump or a mixed (semi-radial) pump, or any other similar pump. For example, the pump can be a mixed pump as described in patent application FR-2,899,944 (U.S. Pat. No. 8,221,067). According to another example, the pump can be a Poseidon® type pump as illustrated in FIG. 1.

The fluid compression or pumping device can be used for any type of fluid: liquid only, gas only, or a multiphase fluid (comprising gas and liquid for example).

According to an embodiment of the disclosure, the compression or pumping device can be used for pumping a multiphase effluent. The compression device of the disclosure enables better equalization of a multi-phase flow, as well as a significant decrease in the pressure fluctuations occurring downstream from the diffuser and generated by the presence of vortices in the diffuser channels.

In embodiments, the compression or pumping device can be used for pumping a multiphase petroleum effluent comprising a mixture of water, oil and gas, and possibly solid particles. In embodiments, the design of the pump might be similar to ones described in patent applications FR-2,333,139, FR-2,471,501 (U.S. Pat. No. 4,365,932), FR-2,665,224 (U.S. Pat. No. 5,375,976) and FR-2,743,113 (U.S. Pat. No. 6,149,385).

FIG. 9 diagrammatically shows, in axial section, one stage of an embodiment of the device according to the disclosure. A rotor (of axis A) comprising a shaft 10 might be driven into rotation by motive means (not represented) such as, for example but not exclusively, an electric motor, and possibly a transmission device allowing notably to adapt the rotational speed of the shaft of the motor to the rotational speed at which shaft 10 is to be driven are placed in housing 9 (stator of the device). Shaft 10 might for example be held in position in the housing 9 by at least two distinct bearings (not represented). FIG. 9 shows one impeller 1 whose function is to increase the energy of the fluid. Impeller 1 is secured to shaft 10, by way, for example of press fitting. The stage also comprises one diffuser 2 according to one embodiment of the disclosure. The diffuser 2 might be secured to casing 9, for example by means of fastening screws (not represented).

Numerical simulations allow to represent the axial component of the fluid flow velocity in different planes passing through the diffuser, distributed from the leading edge to the trailing edge.

FIG. 10 shows an example of the axial component of the flow velocity Va (m/s) for a diffuser according to the prior art. The diffuser comprises a plurality of vanes 4. The axial component of the flow velocity Va is shown on the gray scale wherein the white areas correspond to negative values, indicating a blocking effect, and the darkest areas correspond to high values. It can be noted that all the channels might not operate identically, which indicates a hydraulic disturbance from one channel to another.

FIG. 11 shows an example of the axial component of the flow velocity for a diffuser according to embodiments of the disclosure. In the example of FIG. 9, the diffuser comprises a plurality of vanes 4, each vane 4 comprising a slot 5 substantially in the center thereof. The axial component of the flow velocity Va is shown on the gray scale wherein the white areas indicate negative values, and the darkest areas correspond to high values. A significant decrease in the number and the extent of such white areas showing the blocking effect, can be noted in this FIG. 9 in comparison with FIG. 10.

These example of numerical simulations allow to show that, for a diffuser of the prior art a blocking effect might occur within the channels of the diffuser. On the other hand, numerical simulations performed with an example of a diffuser according to the disclosure show a beneficial effect of the slot(s) provided on the diffuser, with a better homogenization of the flow from one channel to another (as shown on FIGS. 10 and 11).

The invention claimed is:

1. A diffuser for a fluid compression device, comprising a hub and a plurality of vanes mounted on the hub, wherein each vane comprises a slot provided at an angle to a radial direction of the fluid compression device, wherein the slot has a rectangular, oblong, or parallelogram shape in a plane parallel to an axial direction of the fluid compression device, the slot starting at a distance ranging between 10% and 60% of an axial length of each vane, wherein the slot is provided over a total height of each vane from the hub to a radially outer edge of each vane, and wherein the slot is inclined toward downstream from the hub to the radially outer edge of each vane according to a direction of flow of fluid on the diffuser such that an opening of the slot onto the radially outer edge of the vane is arranged downstream from an end of the slot adjacent the hub.

2. The diffuser as claimed in claim 1, wherein the slot has an axial length ranging between 10% and 40% of the axial length of each vane.

3. The diffuser as claimed in claim 1, wherein each vane comprises a single slot.

4. The diffuser as claimed in claim 1, wherein the slot starts at a distance ranging between 45% and 55% of the axial length of each vane.

5. A fluid compression device comprising a housing, at least one impeller within the housing, the at least one impeller comprising at least one vane, wherein the fluid compression device comprises at least one diffuser as claimed in claim 1, the at least one diffuser being arranged within the housing, upstream or downstream from the at least one impeller.

* * * * *